US007811110B2

(12) United States Patent
He et al.

(10) Patent No.: US 7,811,110 B2
(45) Date of Patent: Oct. 12, 2010

(54) ELECTRICAL CONNECTOR WITH IMPROVED CONTACT ARRANGEMENT

(75) Inventors: Jia-Yong He, Kunshan (CN); Qi-Sheng Zheng, Kunshan (CN); Hao Gu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/384,820

(22) Filed: Apr. 9, 2009

(65) Prior Publication Data

US 2009/0258514 A1 Oct. 15, 2009

(30) Foreign Application Priority Data

Apr. 9, 2008 (CN) ..... 2008 1 0023595
Apr. 21, 2008 (CN) ..... 2008 2 0034873

(51) Int. Cl.
*H01R 27/00* (2006.01)

(52) U.S. Cl. ..... 439/218; 439/607.27

(58) Field of Classification Search ..... 439/217, 439/218, 607.35–607.36, 607.55, 607.27
See application file for complete search history.

(56) References Cited

U.S. PATENT DOCUMENTS

| | | | | |
|---|---|---|---|---|
| 5,779,489 | A | 7/1998 | Davis et al. | |
| 7,128,617 | B2 * | 10/2006 | Wang et al. | 439/660 |
| 7,318,752 | B2 * | 1/2008 | Fujimoto et al. | 439/660 |
| 7,422,488 | B1 * | 9/2008 | Wu | 439/676 |
| 2007/0173121 | A1 * | 7/2007 | Chiang | 439/609 |

* cited by examiner

*Primary Examiner*—Ross N Gushi
(74) *Attorney, Agent, or Firm*—Wei Te Chung; Andrew C. Cheng; Ming Chieh Chang

(57) ABSTRACT

An electrical connector (100) includes an insulative housing (10) and a number of contacts (4) retained in the insulative housing (10). The insulative housing (10) includes a first body portion (11) and a first tongue (12) extending from the first body portion (11). The first tongue (12) defines a number of first receiving slots (13). The contacts (4) comprise a plurality of first contacts (41) insert molded in the insulative housing (10) and a number of second contacts (42). Each first contact (41) has a flat first contact portion (411) extending to the first tongue (12). Each second contact (42) has an elastic second contact portion (421) received in the first receiving slot (13). The first contact portions (411) and the second contact portion (421) are arranged at a same side of the first tongue (12) along a thickness direction of the first tongue (12).

20 Claims, 15 Drawing Sheets

ELECTRICAL CONNECTOR WITH IMPROVED CONTACT ARRANGEMENT

BACKGROUND OF THE INVENTION

1. Field of the Invention

The present invention relates to an electrical connector, and more particularly to electrical connectors with improved contact arrangement.

2. Description of Related Art

Universal Serial Bus (USB) is used widely in variety electronic devices as a standard and simple interface. Up to now, previous notable releases of the USB specification were 0.9, 1.0, 1.1 and 2.0. Equipment conforming to any version of the standard will also work with devices designed to any previous specification (known as: backward compatibility).

USB mentioned above supports three data rates respectively as follows: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s).

USB connector is soldered on a circuit board of a computer usually. The USB 2.0 A type connector according to USB-IF usually comprises an insulative housing with a tongue plate extending forwardly, four contacts retained in the insulative housing and a metal shield. Each contact has a contact portion extending to a lower side of the tongue plate and exposing out thereof flexibly. The contact portion presents as arc type and can move along a thickness direction of the tongue. The four contacts comprise a power contact, a grounding contact, a − data contact and a + data contact. The − data contact and + data contact are located between the power contact and the grounding contact. The metal shield encloses the tongue plate and forms a first receiving space for receiving a USB plug. However, as the development of electric industry, even the USB 2.0 can not satisfy the requirement of many electric devices. For example, under a circumstance transmitting an audio or video file, which is always up to hundreds MB, even to 1 or 2 GB, currently transmission rate of USB is not sufficient.

An electrical connector which is based on USB interface, but has a high signal transmission speed and an improved contacts arrangement, is desired to overcome the disadvantage of the prior art.

BRIEF SUMMARY OF THE INVENTION

According to the present invention, an electrical connector comprises: an insulative housing comprising a first housing, the first housing comprising a first body portion and a first tongue extending from the first body portion, the first tongue defining a plurality of first receiving slot; and a plurality of contacts retained in the insulative housing, the contacts comprising a plurality of first contacts insert molded in the first housing and a plurality of second contacts, each first contact having a flat first contact portion extending to the first tongue and a first soldering portion extending out of the first housing, each second contact having an elastic second contact portion received in the first receiving slot and a second soldering portion extending out of the first housing, the first contact portions and the second contact portion being arranged at a same side of the first tongue along a thickness direction of the first tongue.

According to another aspect of the present invention, an electrical connector comprises: an insulative housing comprising a body portion and at least a tongue extending from the body portion, the tongue defining a plurality of receiving slots; a plurality of contacts retained in the insulative housing, the contacts comprising a plurality of first contacts insert molded in the insulative housing, and a plurality of second contacts assembled to the insulative housing, each first contact having a first contact portion extending to a free end of the tongue, each second contact portion having a second contact portion received in the receiving slot and spaced apart from the first contact portion along a length direction of the tongue; and a metal shell covering the insulative housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
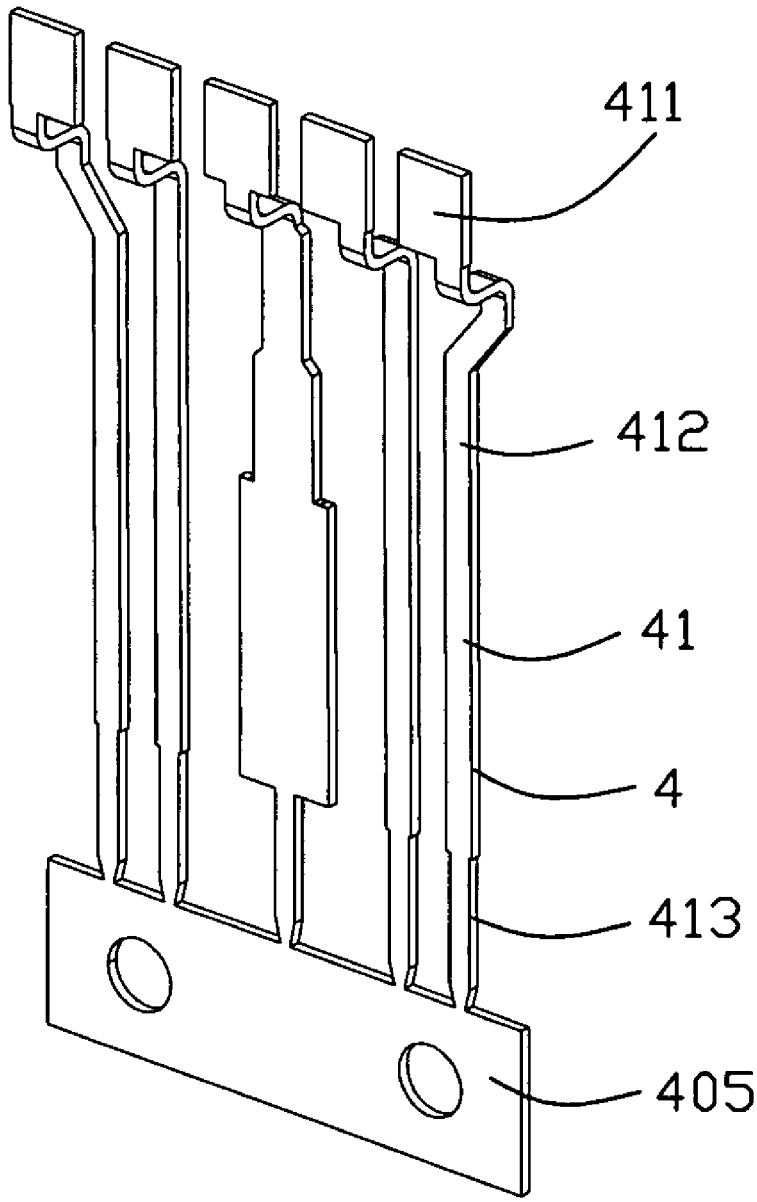
FIG. 1 is a perspective view of first contacts with carry of an electrical connector according to a first embodiment of the present invention.
Figure 2:
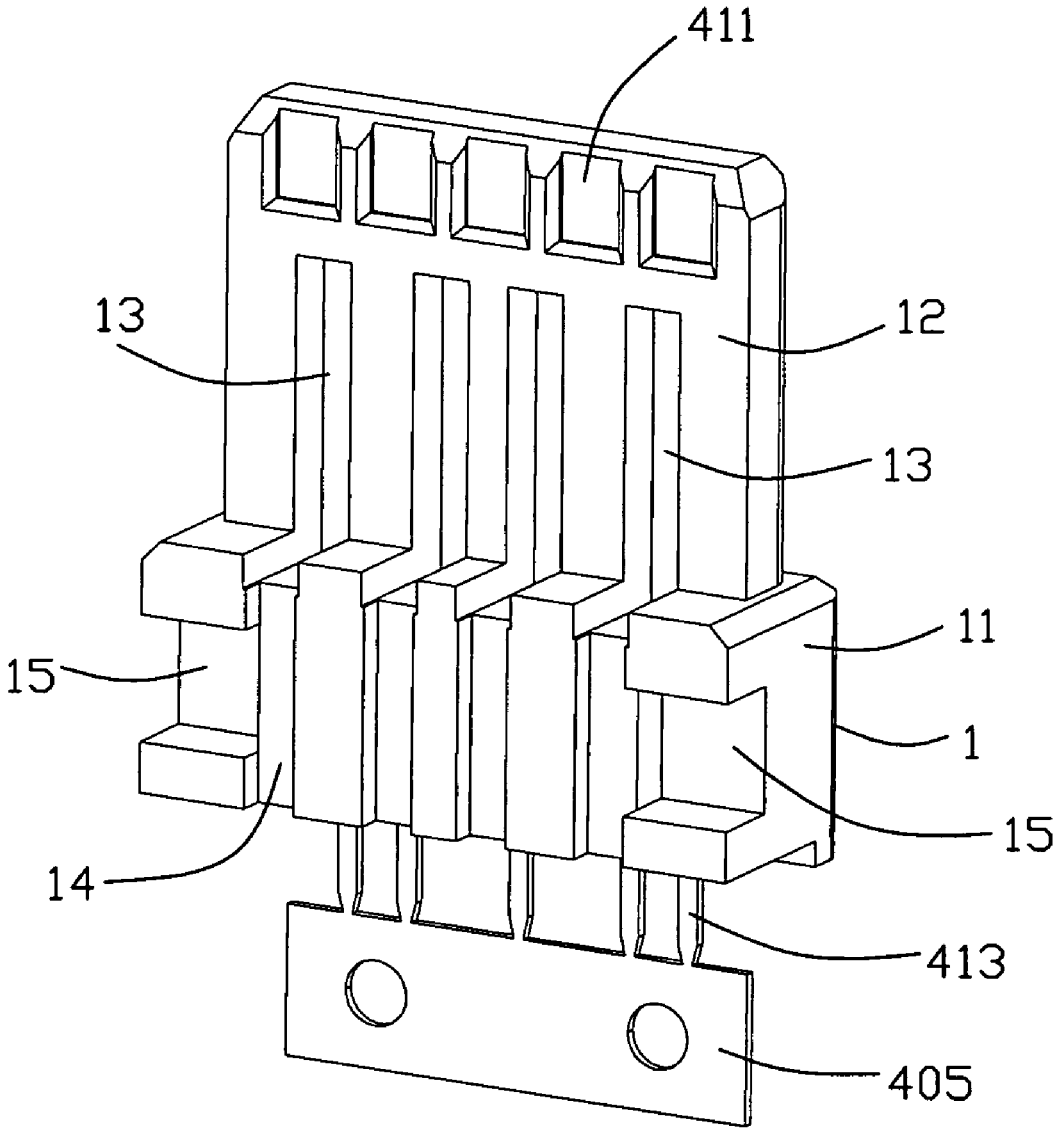
FIG. 2 is a perspective view of a first housing insert molding around the first contacts with carry of the electrical connector of the present invention.
Figure 3:
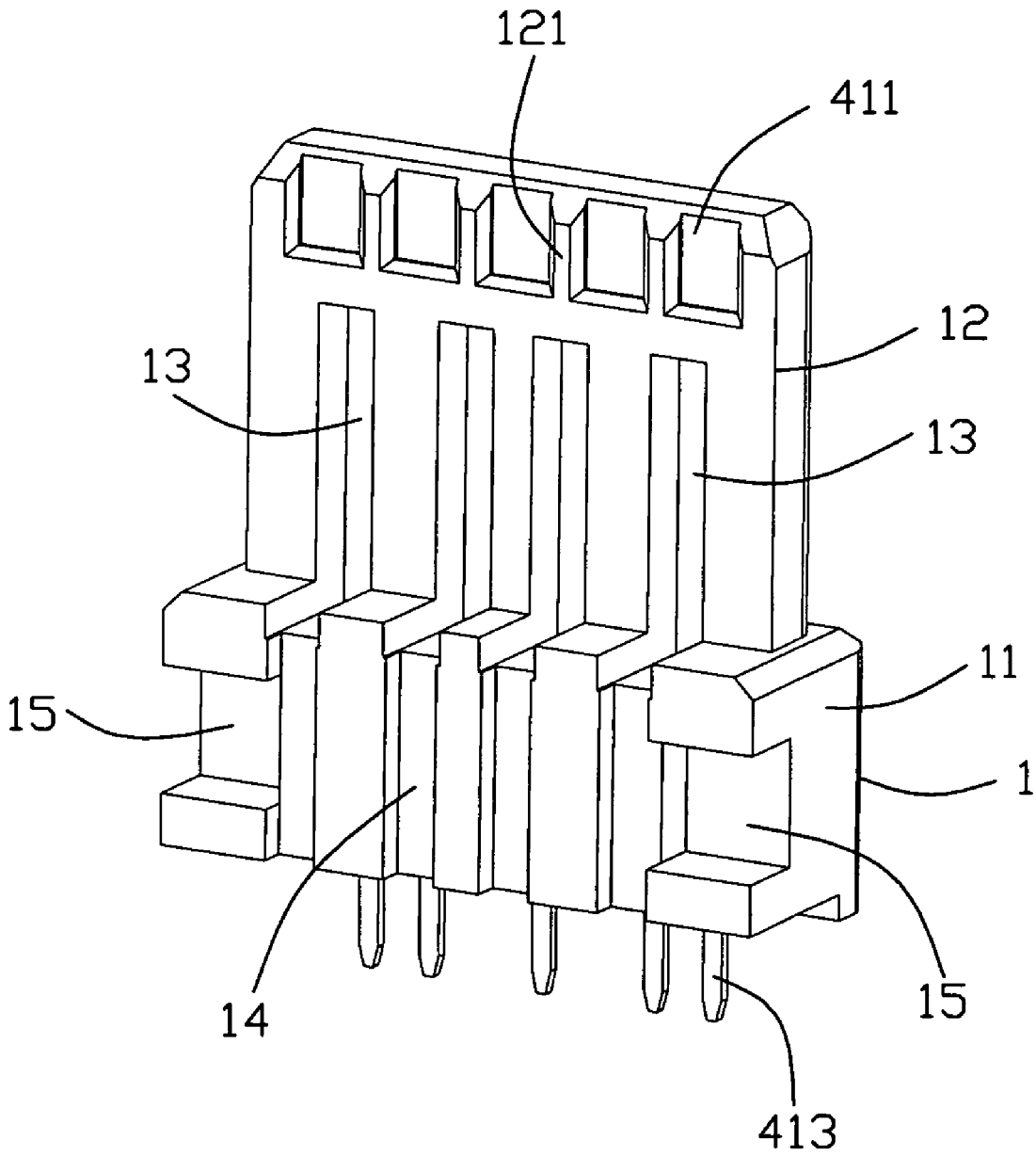
FIG. 3 is a perspective view of the first housing with the first contacts without carry of the electrical connector of the present invention.
Figure 4:
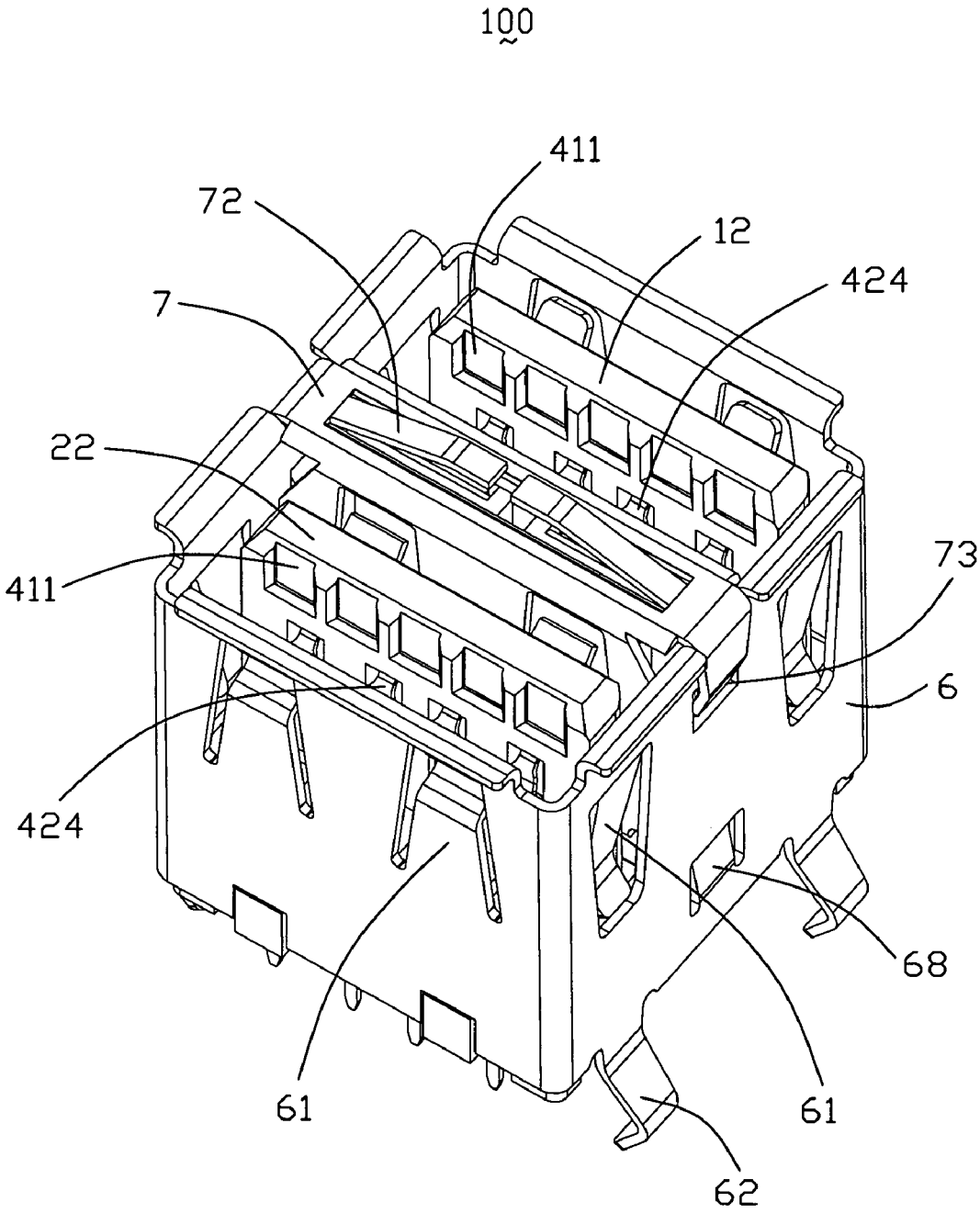
FIG. 4 is a perspective view of the electrical connector of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-8, an electrical connector 100 according to a first embodiment of the present invention is disclosed. The electrical connector 100 extends along a vertical direction. The electrical connector 100 comprises an insulative housing 10, a plurality of contacts 4 retained in the insulative housing 10, a spacer 5 mounted on the insulative housing 10 and a metal shell covering the insulative housing 10. The contacts 4 comprise a plurality of first contacts 41 and a number of second contacts 42. The metal shell has an outer shell 6 and an inner shell 7.

Referring to FIGS. 5-8, the insulative housing 10 comprises a first housing 1, an insulator 3 and a second housing 2 assembled together along a front-to-back direction. The first housing 1 comprises a first body portion 11 and a first tongue 12 extending upwardly from a top end of the first body portion 11. There are five first contacts 41 insert molded in the first housing 1, and each has a flat first contact portion 411, a first soldering portion 413 extending downwardly and out of the first housing 1, and a first securing portion 412 connecting the first contact portion 411 and the first soldering portion 413. The first contact portions 411 are insert molded in a top end of the first tongue 12 and partly exposed to air for electrically connecting a corresponding plug (not shown), but not extend out a front side surface of the first tongue 12. The first tongue 12 has a plurality of ribs 121 between adjacent first contact portions 411 to separate the first contact portions 411 from each other. The first securing portion 412 bends rearwards from the first contacts 411 and extends downwardly. The first securing portions 412 are insert molded in the first tongue 12 and the first body portion 11.

The first contacts 41 retained in the first housing 1 comprise two pairs of differential signal contacts and a grounding contact located between the two pairs of differential signal contacts. The first securing portion 412 of the grounding contact is wider than that of the differential signal contacts for better reducing disturb between two pairs of differential signal contacts.

The first tongue 12 defines a plurality of first receiving slots 13 below the first contact portions 411. The first receiving slots 13 are arranged in a row in a width direction of the first tongue 12 and extend along a length direction of first tongue 12. The first tongue 12 is formed with a plurality of first position holes 16 corresponding to the first contact portions 411 and a number of first depressions 17 located below the position holes 16 and between adjacent first contacts 41. A mold (not shown) used for molding the first housing 1 has a plurality of small posts at the position of first position holes 16 for positioning the first contacts 41, and a number of pins at the position of first depressions 17 for preventing the adjacent first contacts 41 from contacting with each other. The first contacts 41 are insert molded in the first housing 1, thereby the first contacts 41 need not be inserted into the first housing 1 for decreasing assembly cost of the electrical connector 100, and the first contacts 41 can not puncture the first housing 1. In addition, referring to FIGS. 1-3, a carry 405 connects a rear sides of the first contacts 41 for connecting the first contacts 41 together, and fixing the first contacts 41 in the mold before the first housing 1 is insert molded around the first contacts 41. The carry 405 is cut out when the first housing 1 is completely molded.

The first body portion 11 defines a pair of first recesses 15 at a front side thereof and a plurality of first installed slots 14 between the two first recesses 15. There are four second contacts 42 assembled in the first housing 1. The four second contacts 42 each has a second contact portion 421 extending upwardly, a second soldering portion 423 extending downwardly and a second securing portion 422 connecting the second contact portion 421 and the second soldering portion 423. The second contact portions 421 are cantileveredly received in the first receiving slots 13 of the first tongue 12. The second contact portion 421 has an elastic portion 424 extending out of the first receiving slot 13. The second securing portions 422 are retained in the first installed slots 14. The second securing portions 422 are bended forwardly from a lower end of the second contact portions 421 and extend downwardly. The second soldering portions 423 extend out of the first housing 1.

Figure 5:
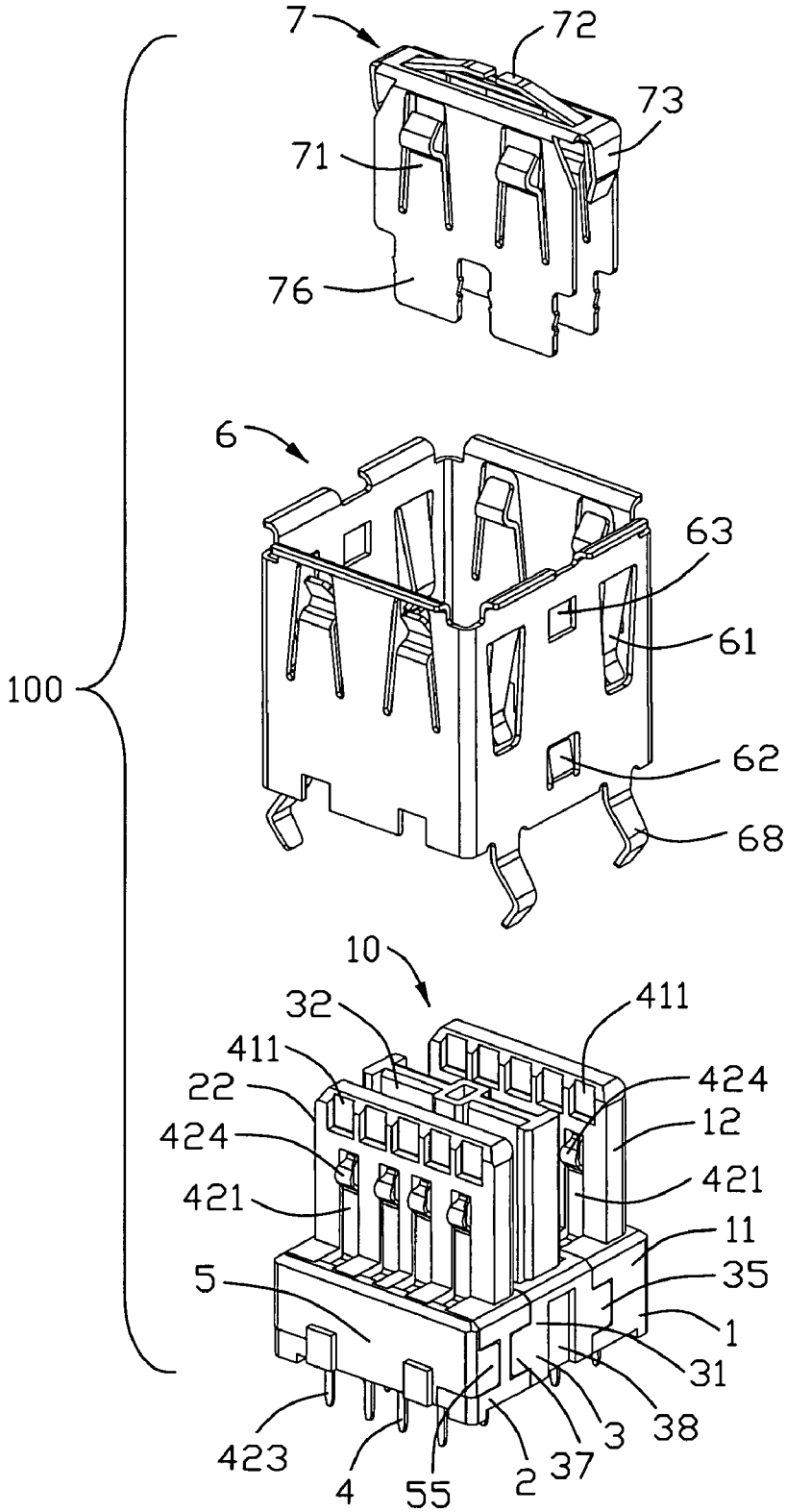
FIG. 5 is a partial exploded view of the electrical connector shown in FIG. 4.
Figure 6:
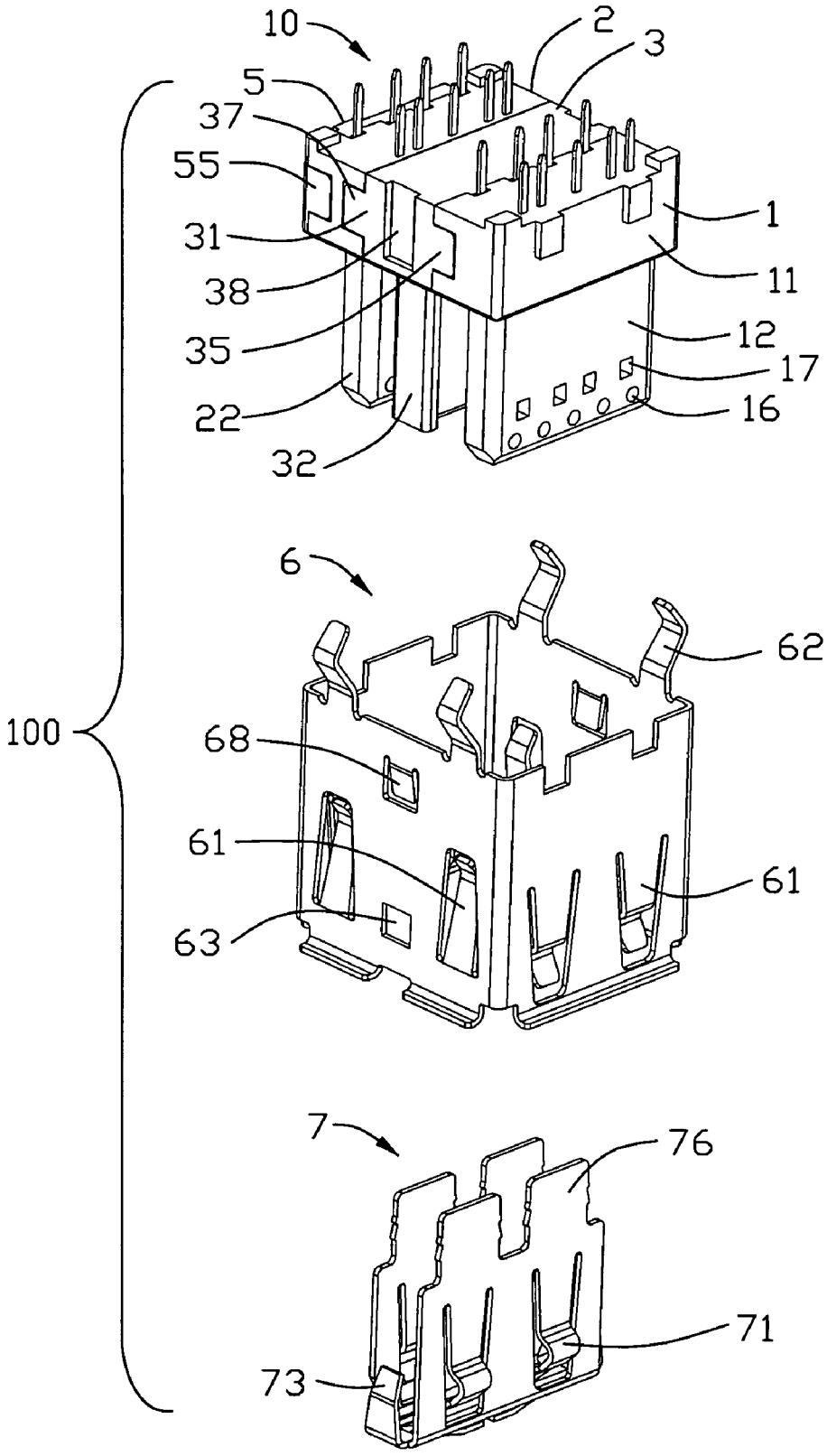
FIG. 6 is a view similar to FIG. 5, while taken from another aspect.
Figure 7:
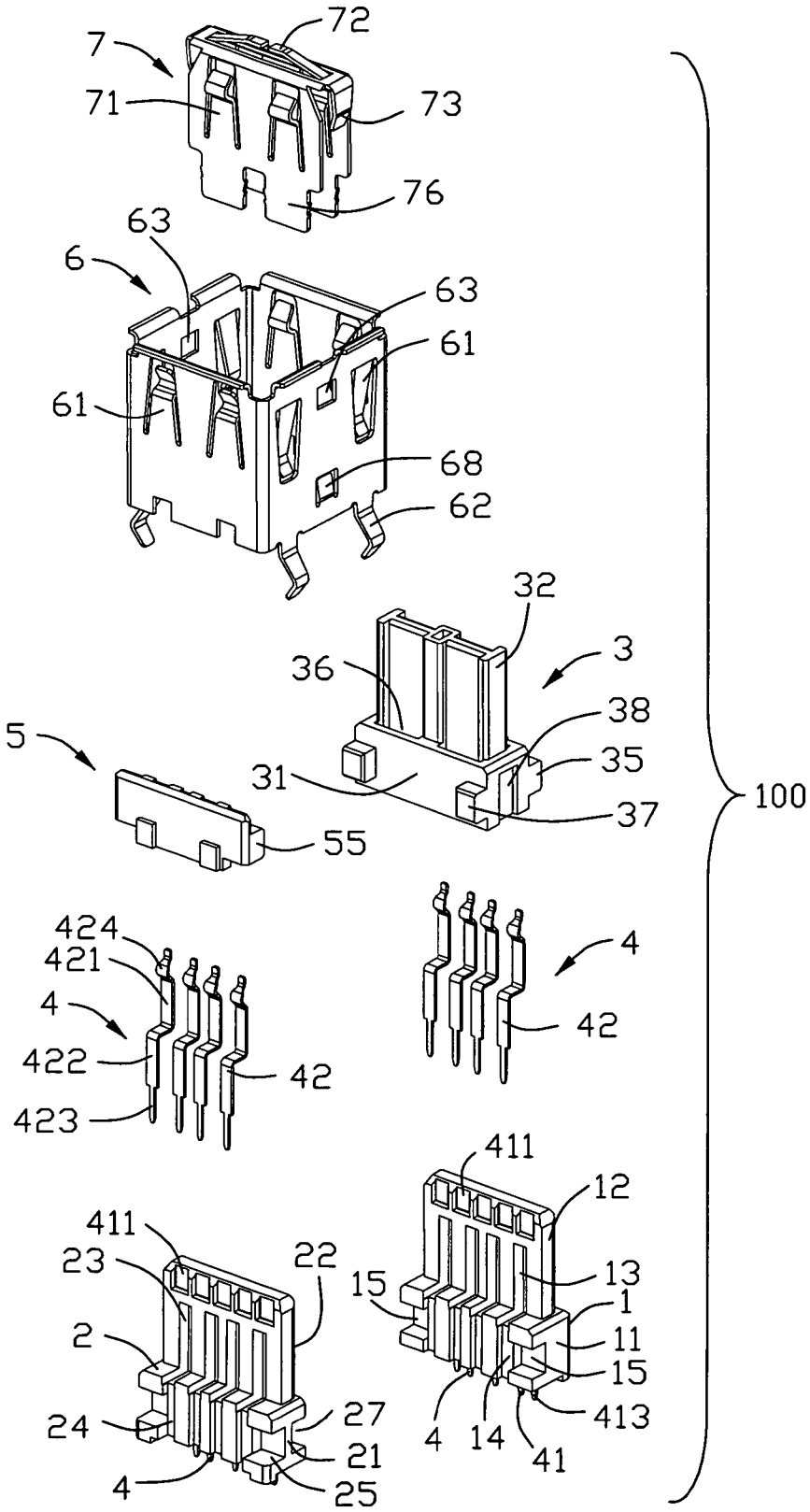
FIG. 7 is an exploded view of the electrical connector shown in FIG. 4.
Figure 8:
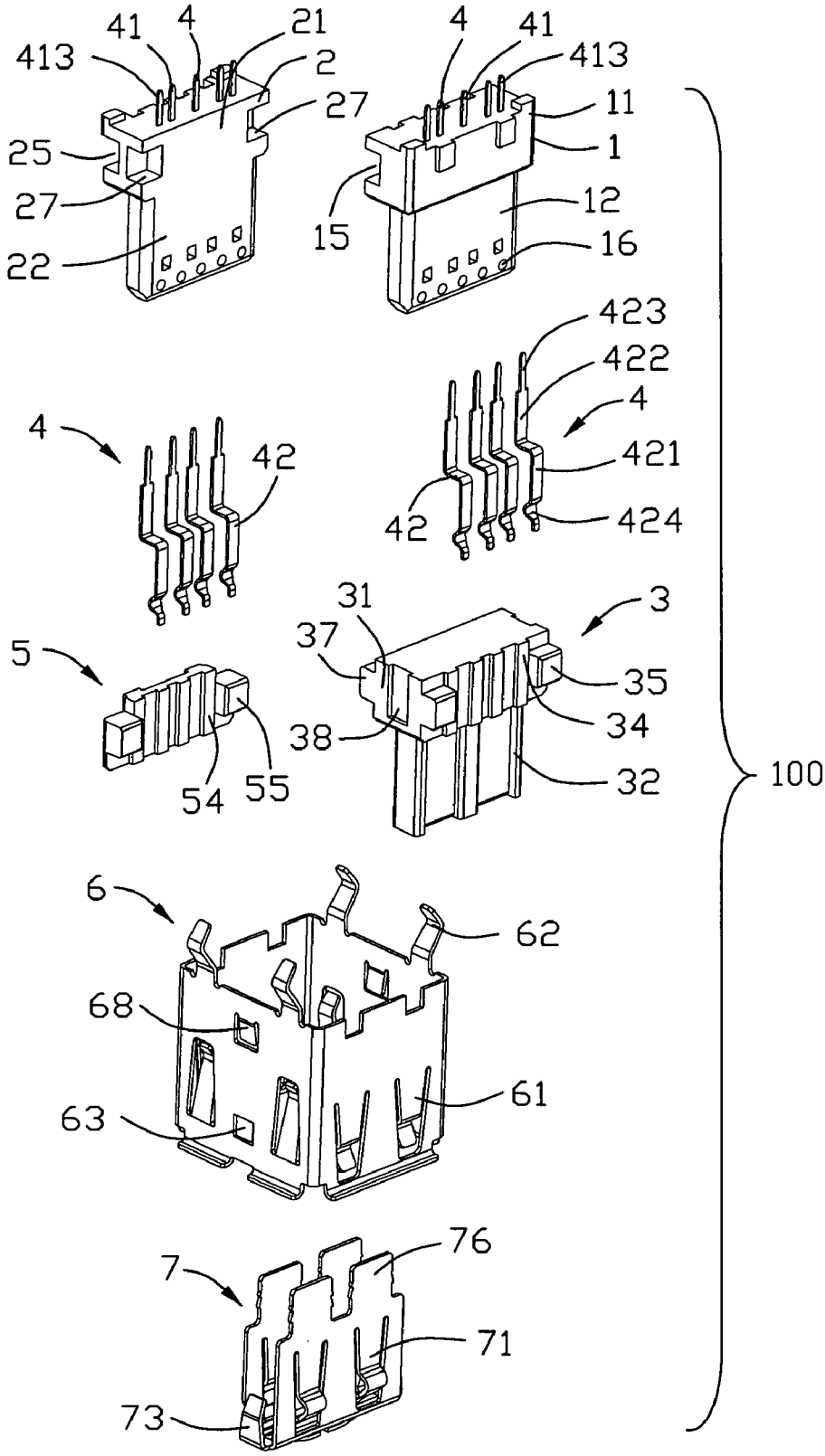
FIG. 8 is a view similar to FIG. 7, while taken from another aspect.
Figure 9:
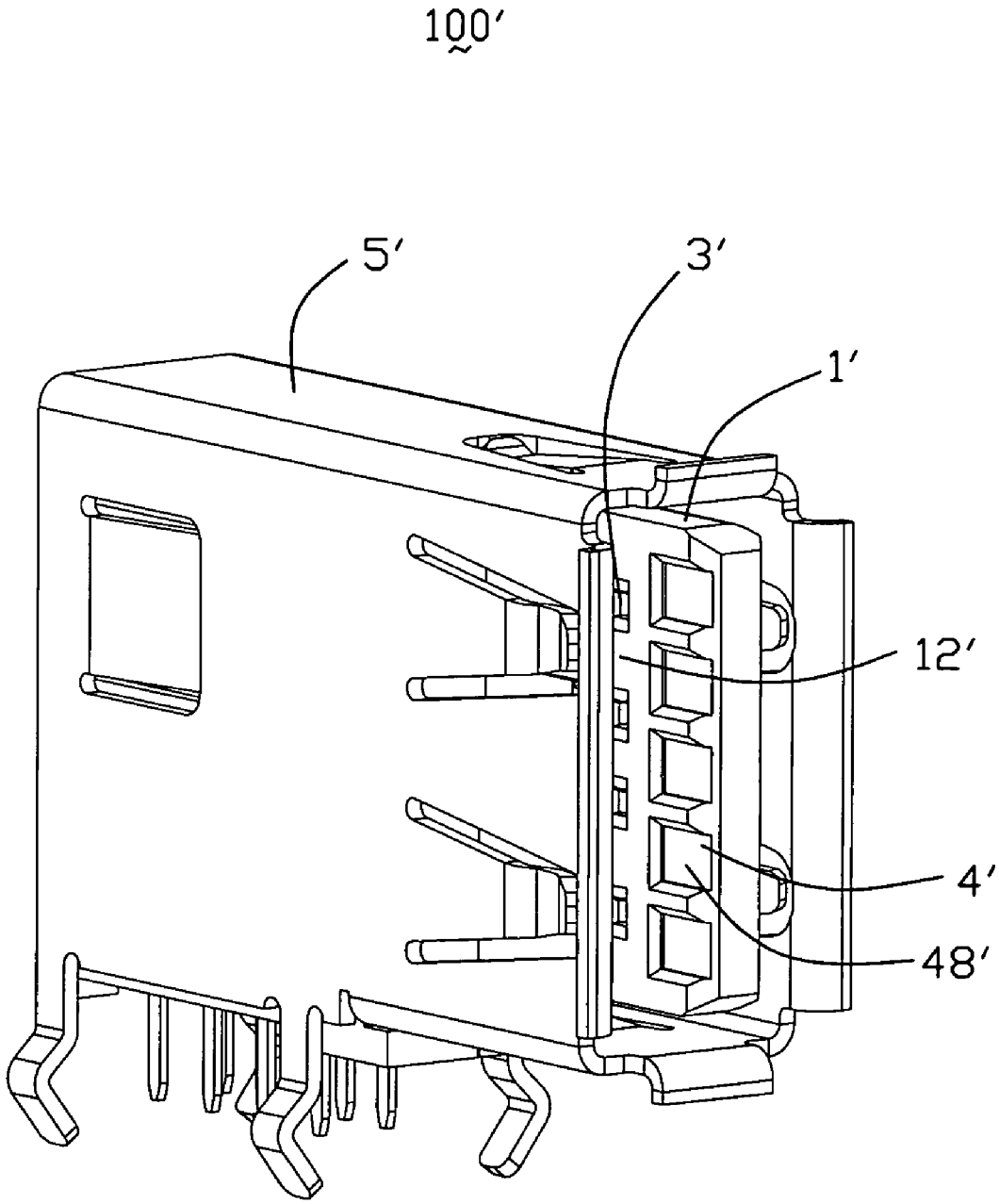
FIG. 9 is a perspective view of an electrical connector according to a second embodiment of the present invention.
Figure 10:
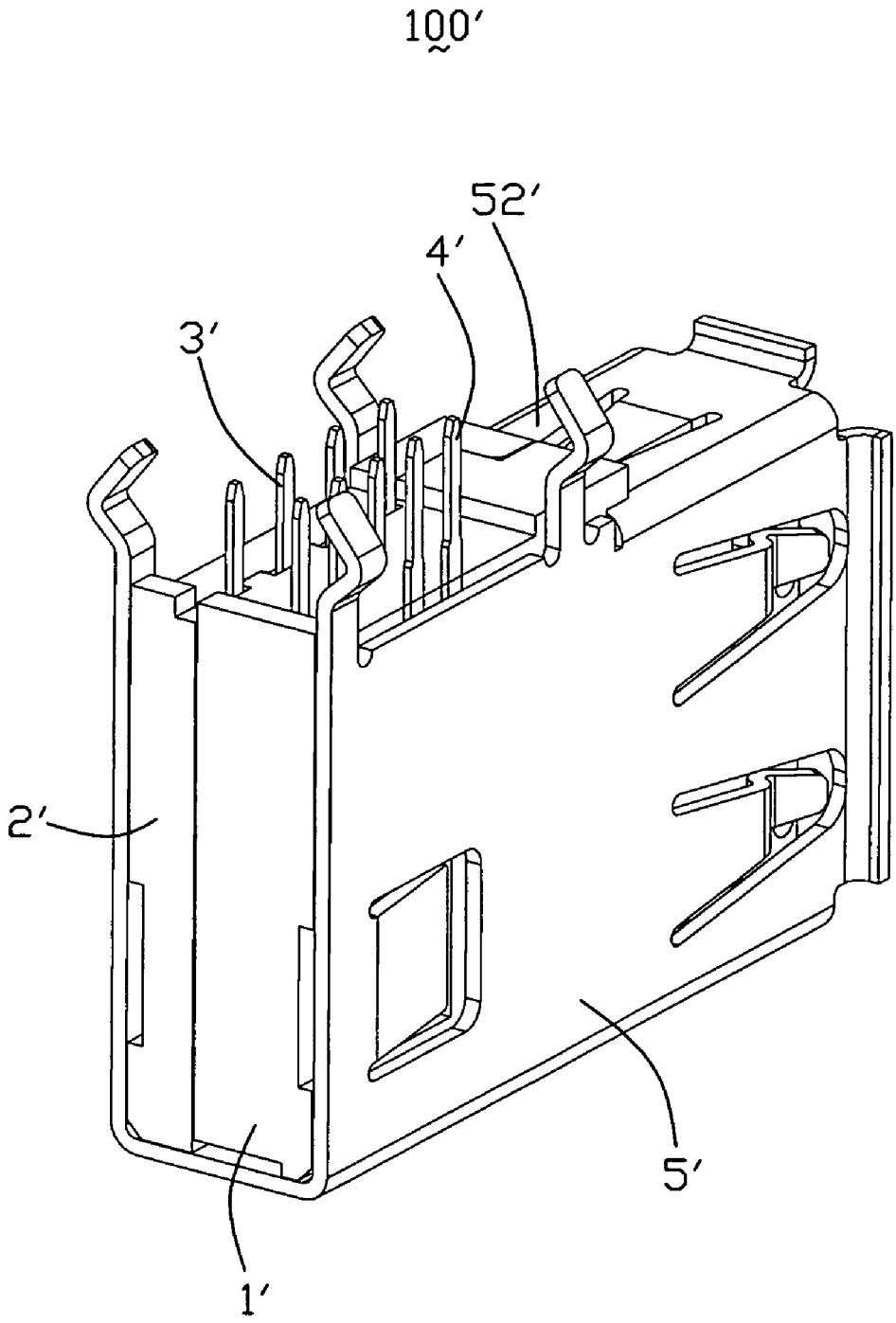
FIG. 10 is a view similar to FIG. 9, while taken from another aspect.
Figure 11:
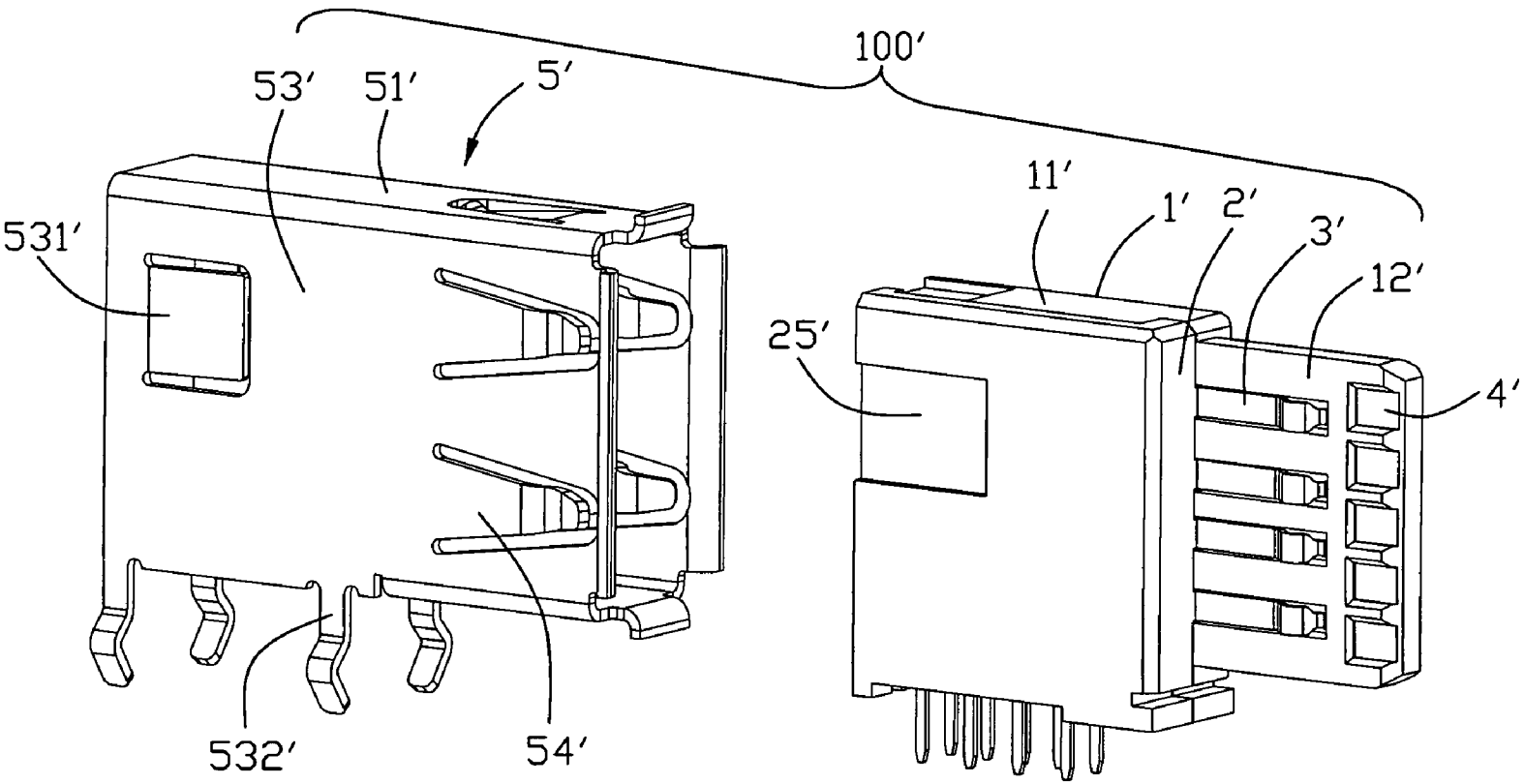
FIG. 11 is a partial exploded view of the electrical connector shown in FIG. 9.
Figure 12:
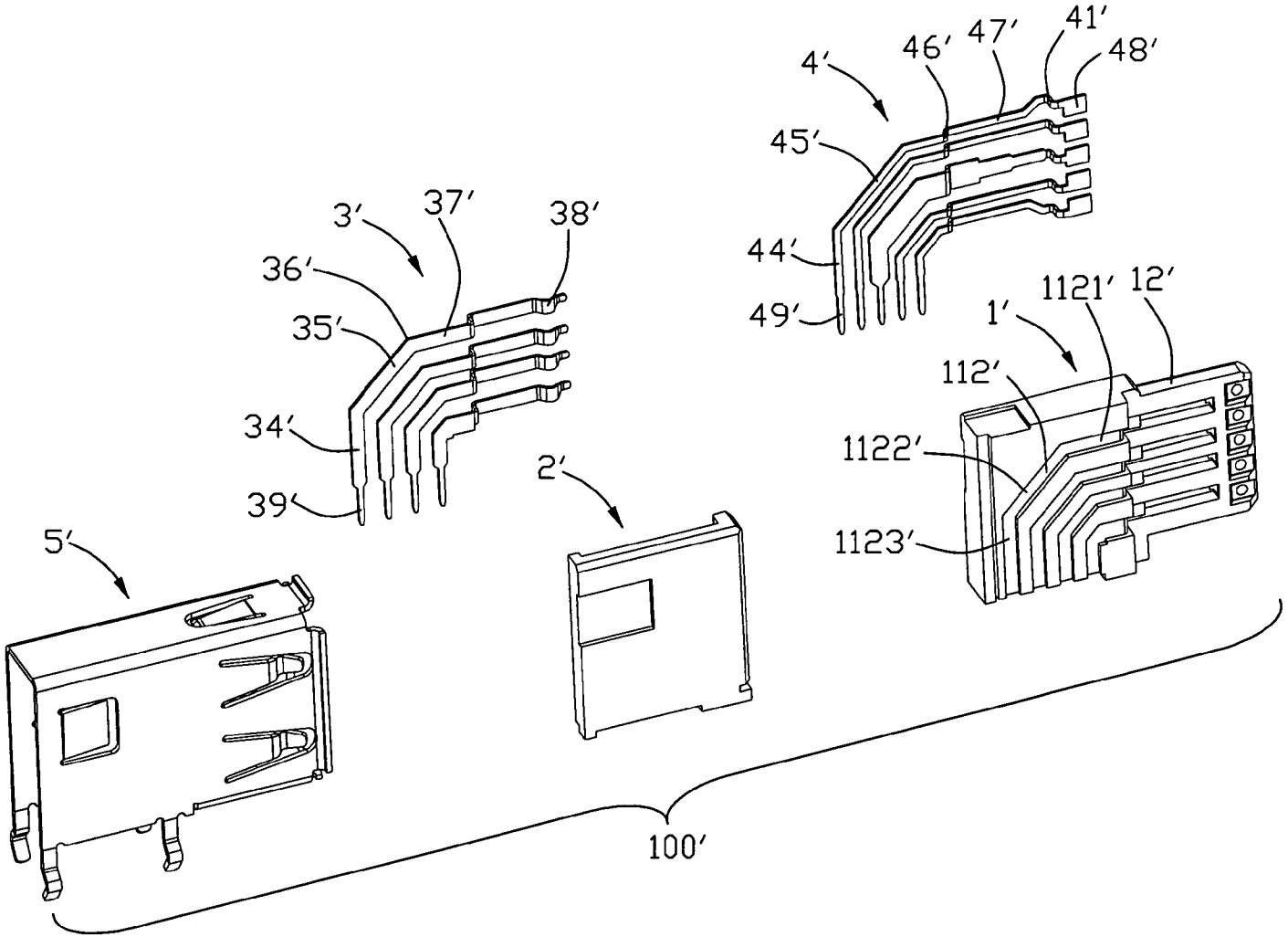
FIG. 12 is an exploded view of the electrical connector shown in FIG. 9.
Figure 13:
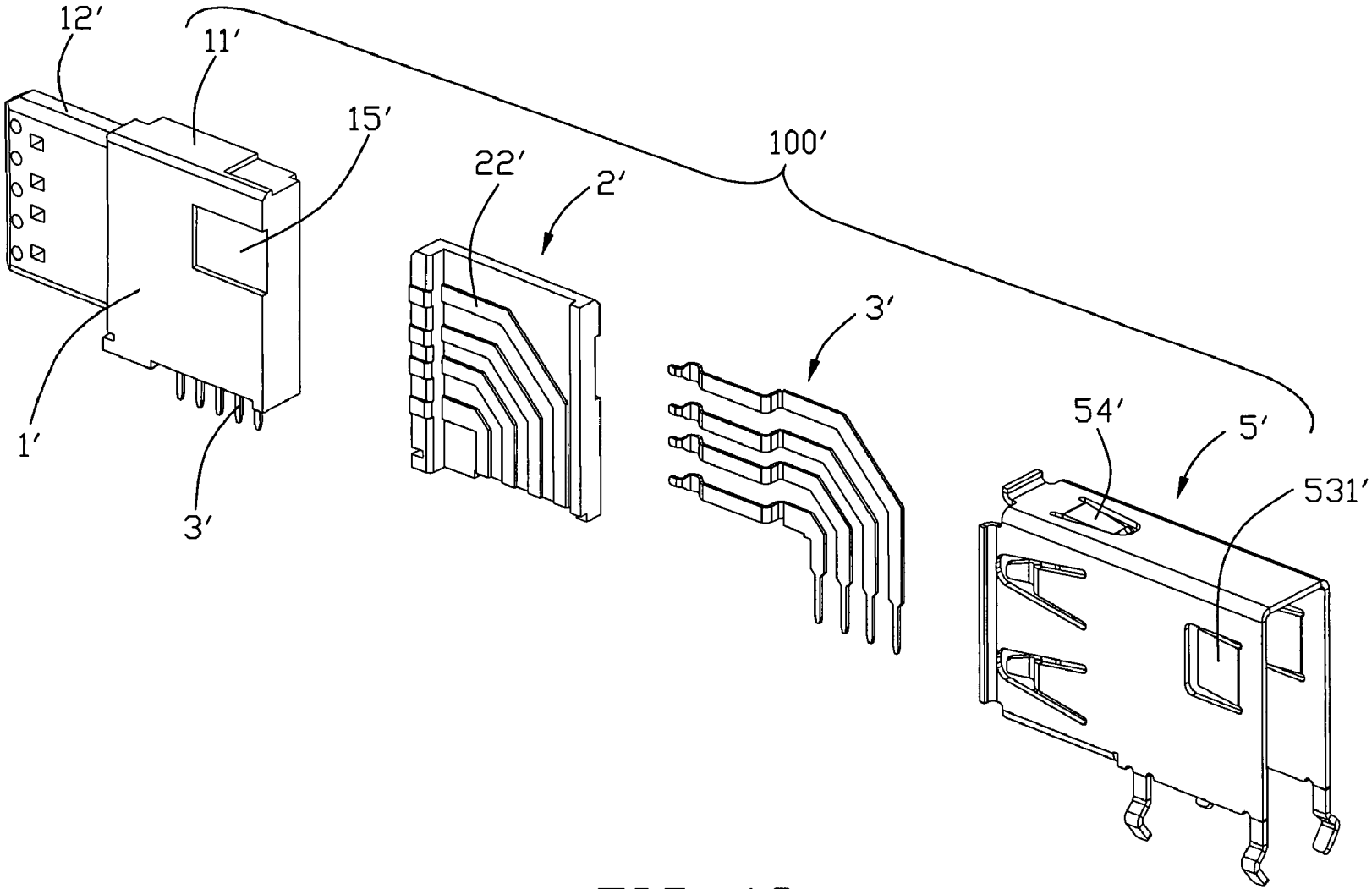
FIG. 13 is a view similar to FIG. 12, while taken from another aspect.

Referring to FIG. 5, the first contact portions 411 and the second contact portions 421 are all arranged in the front side of the first tongue 12 along the thickness direction of the tongue 12. The first contact portions 411 are located at an upper side of the second contact portions 421 and spaced apart from the second contact portions 421 along a length direction of the first tongue 12. The flat first contact portion 411 and the elastic second contact portion 421 are located at different plane along the thickness direction of the first tongue 12. The second contacts 42 are adapted for USB protocol and an arrangement of the second contacts is compatible to a standard USB 2.0 A type plug 500. The second contacts 42 comprise four contacts which are a power contact, a pair of differential signal contacts and a grounding contact, and the differential signal contacts are located between the power contact and the grounding contact.

The insulator 3 comprises a base portion 31 and a clapboard 32 extending upwardly from a top end of the base portion 31. The base portion 31 defines a plurality of holes 36 recessed from the top end thereof, a pair of cutouts 38 at left and right sides thereof, a pair of first protrusions 35 at a rear side thereof and a plurality of first blocks 34 between two first protrusions 35, and a pair of second protrusions 37 projecting forwardly from a front side thereof. The first protrusions 35 engage with the first recesses 15 for fixing the insulator 3 to the first housing 1. The first blocks 34 engage with the first installed slots 14 and press the second securing portions 422 for fastening the second contacts 42 on the first housing 1.

The second housing 2 comprises a second body portion 21 and a second tongue 22 extending upwardly from a top end of the second body portion 21. The second body portion 21 defines a pair of second recesses 27 at a rear side thereof to engage with the second protrusions 37 of the insulator 3 for fixing the second housing 2, insulator 3 and the first housing 1 together, thereby the insulator 3 is sandwiched by the first housing 1 and the second housing 2. The second body portion 21 defines a pair of third recesses 25 at a front side thereof and a plurality of second installed slots 24 between the two third recesses 25. The second installed slots 24 extend along an up-to-down direction of the second housing 2. The surplus first contacts 41 are insert molded in the second housing 2 same as the first contacts 41 on the first housing 2. The surplus second contacts 42 are assembled to the second housing 2 same as the second contacts 42 on the first housing 1. The arrangement of the surplus first and second contacts 41, 42 on the second housing 2 is same to that of the first and second contacts 41, 42 on the first housing 1.

The spacer 5 has a pair third protrusions 55 and plurality of second blocks 54 between two third protrusions 55. The third protrusions 55 engage with the third recesses 25 for fixing the spacer 5 to an outside of the second housing 2. The second blocks 54 engage with the second installed slots 24 and press the second securing portions 422 of the surplus second contacts 42 for fastening the second contacts 42 on the second housing 2.

The outer shell 6 rings around the insulative housing 10 and the spacer 5 for fixing the first housing 1, insulator 3, the second housing 2 and the spacer 5 together. The outer shell 6 comprises a pair of first spring arms 61 at front and rear sides respectively, a pair of spring tabs 68 at left and right sides respectively for engaging with cutout 28 of the insulator 3, and a pair of first spring arms 61 at two sides of the spring tabs 68 for fastening the corresponding plug. The outer shell 6 has a plurality of mounting legs 62 extending downwardly and an opening 63 at two sides thereof.

The inner shell 7 rings on the clapboard 32 of the insulator 3 and comprises a pair of second spring arms 71 extending toward the first and second tongues 12, 22 respectively, a pair of ground tabs 72 extending toward each other at top side thereof, a pair of mounting tabs 76 extending downwardly for engaging with the holes 36 for fastening the inner shell 7 on the insulator 3. The inner shell 7 has a pair of locking tabs 73 to lock with the openings 63 of the outer shell 6 for grounding.

As fully described above, geometric profiles of the first and second tongue 12, 22 are all substantially same as that of a standard USB 2.0 A type receptacle. The arrangement of second contacts 42 on the first and second tongues 12, 22 are same as that of the standard USB 2.0 protocol. Therefore, the electrical connector 100 is based on the standard USB 2.0 A type receptacle and can mate with the standard USB 2.0 A type plug 500. In addition, the electrical connector 100 adds the first contacts 41 to the standard USB 2.0 A type receptacle, thereby the differential signal contacts in the first contacts 41 increase transmission speed of the electrical connector 100 of the present invention. Besides, because the first contacts 41 is flat and not extend out of the side surface, and the elastic second contacts 42 extend out of the side surface, the standard USB 2.0 A type plug 500 can not contact the first contact 41 but contact with the second contacts 42 stably when the standard USB 2.0 A type plug 500 is withdrawn in the electrical connector 100, and the first and second contacts 41, 42 can contact with the corresponding plug stably when the corresponding plug is withdrawn in the electrical connector 100. Finally, the first contacts 41 are insert molded in the first housing 1 and the second housing 2 respectively and the second contacts 42 are inserted into the first and second housing 1, 2 from a sideward of the first and second housing 1, 2, therefore, the assemble cost can be decreased, and the contacts 4 can not puncture the insulative housing 10.

Referring to FIG. 9-13, an electrical connector 100' according to a second embodiment of the present invention is disclosed. The electrical connector 100' also comprises a first housing 1', a plurality of first contacts 4' and a plurality of second contacts 3' retained on the first housing 1', an insulator 2' retained on the first housing 1', and a metal shell 5 covering the first housing 1' and the insulator 2'. The first contacts 4' transmit the same signals as the first contacts 41 transmit. The second contacts 3' transmit the same signals as the second contacts 42 transmit.

The first housing 1' comprises an upright body portion 11' and a tongue 12' extending forwardly from a front end of the body portion 11'. A geometric profile of the tongue 12' is substantially same as that of a standard USB 2.0 A type receptacle also. The body portion 11' defines a plurality of installed slots 112' at an inner side thereof, and a locking recess 15' recessed from an outside surface thereof. Each installed slot 112' has a level section 1121', an inclined section 1122' and a vertical section 1123'. The tongue 12' has a structure similar to the first and second tongues 12, 22 except that the first and second tongues 12, 22 extend vertically, but the tongue 12' extends uprightly.

The first contacts 4' are insert molded into the first housing 1' and each comprises a first contact portion 48' insert molded in the tongue 12', a first soldering portion 49' extending out of the first housing 1' for being soldered on a circuit board (not shown), and a first securing portion 46' connecting the first contact portion 48' and the first soldering portion 49'. The arrangement of the first contact portion 48' on the first tongue 12' is same to the arrangement of the first contact portion 411 on the first tongue 12. Each first securing portion 46' has a first level portion 47' extending backwardly and outwardly from the first contact portion 48', a first inclined portion 45' extending backwardly and downwardly from a rear end of the first level portion 47', and a first vertical portion 44' extending downwardly from a lower end of the first inclined portion 45'. The first soldering portion 49' extends downwardly from a lower end of the first vertical portion 44'. The first contact portions 48' and the first level portions 47' are arranged in different plane along a thickness direction of the tongue 12'.

The first contacts 4' comprise two pairs of differential signal contacts and a grounding contact. The grounding contact is arranged between the two pairs of differential signal contacts for reducing disturb between two pairs of differential signal contacts. The first securing portion 46' of the grounding contact is wider than that of the differential signal contacts for better reducing disturb between two pairs of differential signal contacts.

Each second contact 3' has a second contact portion 38' extending forwardly, a second soldering portion 39' connecting the circuit board, and a second securing portion 36' connecting the second contact portion 38' and the second soldering portion 39'. The structure of the second contact portion 38' is same to that of the second contact portions 421. Each second securing portion 36' has a second level portion 37' extending backwardly and outwardly from the second contact portion 38', a second inclined portion 35' extending backwardly and downwardly from a rear end of the second level portion 37', and a second vertical portion 34' extending downwardly from a lower end of the second inclined portion 35'. The second soldering portion 39' extends downwardly from a lower end of the second vertical portion 34'. The second contact portions 38' are arranged in the tongue 12' same as the second contact portions 421 on the first tongue 12.

The second level portions 37', second inclined portions 35' and second vertical portions 38' of the securing portions 36' are retained in the level sections 1121', inclined sections 1122' and vertical sections 1123' of the installed slots 112' respectively. The second contacts 3' are adapted for USB protocol and an arrangement of the second contacts 3' is compatible to the standard USB 2.0 A type plug 500. The second contacts 3' comprise four contacts which are a power contact, a pair of differential signal contacts and a grounding contact, and the differential signal contacts are located between the power contact and the grounding contact.

The insulator 2' is rectangular and has a plurality of blocks 22' projecting from an inner wall thereof, and a locking recess 25' recessed from an outside surface thereof. Each block 22' has a structure corresponding to the installed slot 112'. When the insulator 2' is assembled to the first housing 1', the blocks 22' engage with the installed slots 112' and press the second securing portions 36' of the second contacts 3' for fastening the second contacts 3' on the first housing 1'.

The metal shell 5' is made of a piece of metal sheet and comprises a pair of side walls 53', a top wall 51' and a lower wall 52'. Each side wall 53' has a pair of spring arms 54' extending forwardly for engaging with a corresponding plug, and a spring tab 531' at a rear position thereof for locking with the locking recesses 15' 25'. The top wall 51' and lower wall 52' each has a spring arm 54' extending backwardly for fastening the plug. Each side wall 53' has a pair of mounting legs 532' extending downwardly for mounting to the circuit board.

Figure 15:
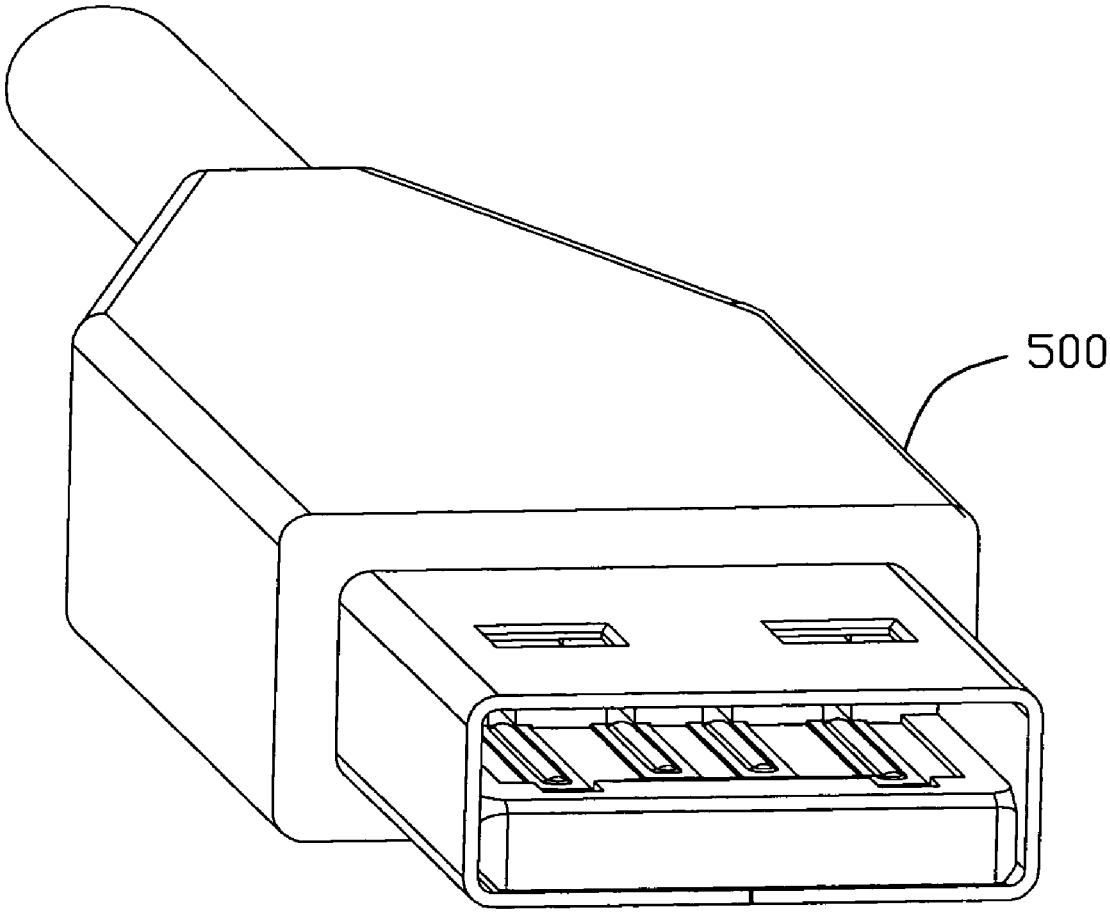
FIG. 15 (PRIOR ART)
FIG. 15 is a perspective view of a standard USB 2.0 A type plug.

Referring to FIGS. 9-13, the electrical connector 100' according to the second embodiment of the present invention is based on the standard USB 2.0 A type receptacle and adds the first contacts 4' to the standard USB 2.0 A type receptacle too, thereby the differential signal contacts in the first contacts 4' increase transmission speed of the electrical connector 100' in the present invention. In addition, the standard USB 2.0 A type plug 500 (shown in FIG. 15) can be inserted into the electrical connector 100' of the present invention and electrically connect with the second contacts 3' for transmitting USB 2.0 signals. Besides, the first contacts 4' are insert molded in the first housing 1', and the second contacts 3' are inserted into the first housing 1' from a sideward of the first housing 1', therefore, the assemble cost can be decreased, and the contacts 4', 3' can not puncture the first housing 1'.

Figure 14:
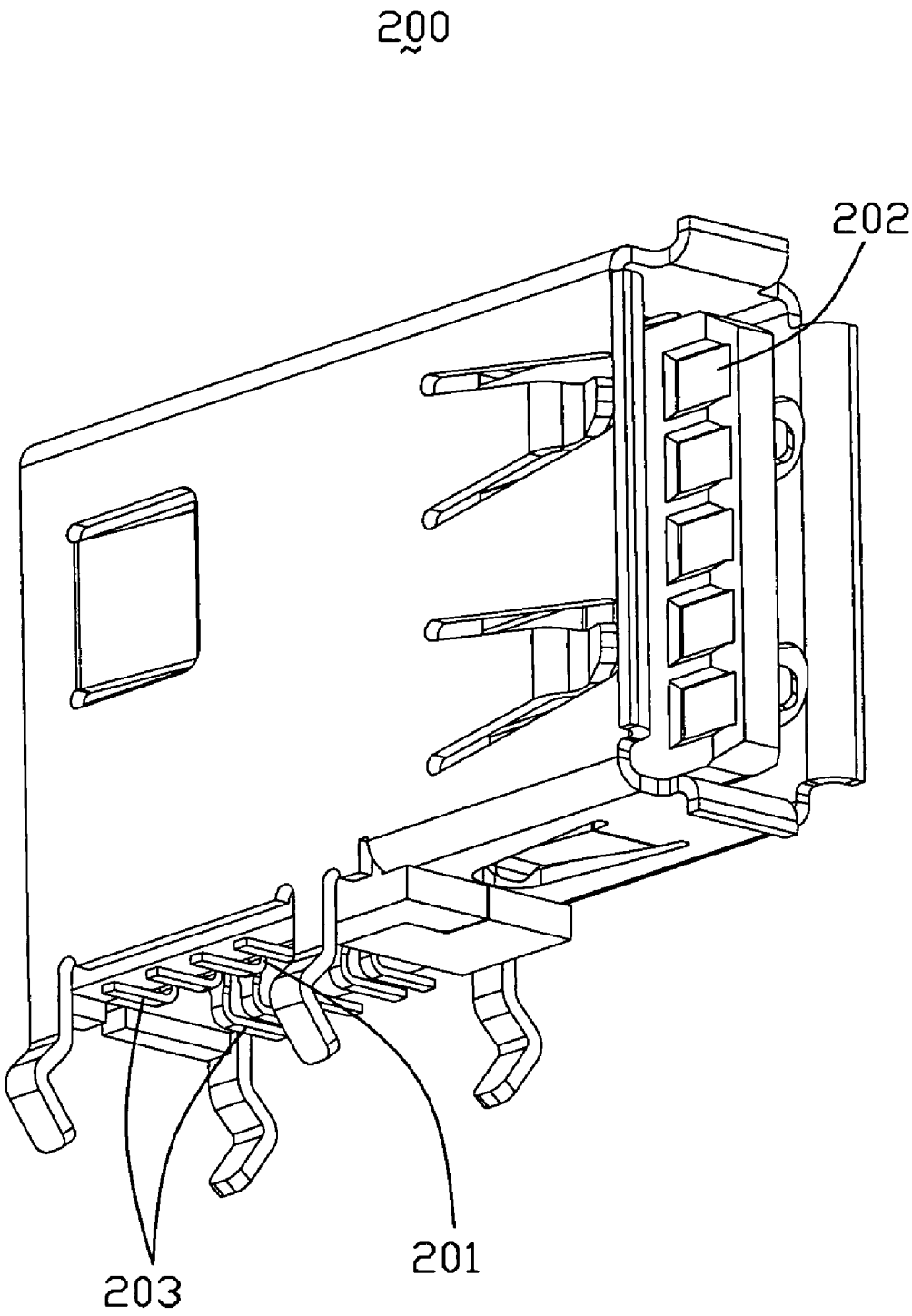
FIG. 14 is a perspective view of an electrical connector according to a third embodiment of the present invention.

Referring to FIG. 14, an electrical connector 200 according to a third embodiment of the present invention is disclosed. Structures of the electrical connectors 100', 200 in the second and third embodiments are similar, and a small difference is that: the soldering portions 203 of the first and second contacts 202, 204 are bended outwardly and horizontally from a lower end of first connecting portion to be surface mounted to a printed circuit board. The electrical connector 200 of the third embodiment can achieve the purpose of the present invention also.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing comprising a first housing, the first housing comprising a first body portion and a first tongue extending from the first body portion, the first tongue defining a plurality of first receiving slot; and a plurality of contacts retained in the insulative housing, the contacts comprising a plurality of first contacts insert molded in the first housing and a plurality of second contacts, each first contact having a flat first contact portion extending to the first tongue and a first soldering portion extending out of the first housing, each second contact having an elastic second contact portion received in the first receiving slot and a second soldering portion extending out of the first housing, the first contact portions and the second contact portion being arranged at a same side of the first tongue along a thickness direction of the first tongue;

wherein the second contacts are adapted for USB protocol and an arrangement of the second contacts is compatible to a standard USB 2.0 A type plug, and the first contacts comprise two pairs of differential signal contacts and a grounding contact between the two pairs of differential signal contacts.

2. The electrical connector according to claim 1, wherein the first body portion has a plurality of first installed slots, and each second contact has a second securing portion connecting the second contact portion and the second soldering portion, and the second securing portion is retained in the first installed slot.

3. The electrical connector according to claim 2, wherein the insulative housing comprises an insulator with a plurality of first blocks to engage with the first installed slots and press the second securing portion.

4. The electrical connector according to claim 3, wherein the first body portion defines at least a first recess, and the insulator has at least a first protrusion to engage with the first recess.

5. The electrical connector according to claim 4, wherein the insulative housing further comprising a second housing similar to the first housing, the insulator is sandwiched between the first housing and the second housing, and the electrical connector further comprising a metal shell and a spacer retained on an outside of the second housing, the metal shell rings around the insulative housing and the spacer to fix the first housing, insulator, the second housing and the spacer together, and forms a receiving space with the first housing, insulator and the second housing to receive a corresponding plug.

6. The electrical connector according to claim 1, wherein the first contact portions are arranged at a free end of the first tongue and spaced apart from the second contact portions along a length direction of the tongue.

7. The electrical connector according to claim 6, wherein the first tongue is formed with a plurality of first ribs between adjacent first contact portions to separate the first contact portions with each other.

8. The electrical connector according to claim 1, wherein the second contact portion is disposed above a side surface of the tongue, and the first contact portion is partly exposed to air and not extend out of the side surface.

9. The electrical connector according to claim 1, wherein a geometric profile of the tongue is substantially same as that of a standard USB 2.0 A type receptacle.

10. An electrical connector comprising:

an insulative housing comprising a body portion and at least a tongue alternatively extending from or attached to the body portion, the tongue having a side surface with a plurality of receiving slots recessed from a rear side thereof;

a plurality of contacts retained in the insulative housing, the contacts comprising a plurality of first contacts insert molded in the tongue, and a plurality of second contacts assembled to the insulative housing, each first contact having a first contact portion extending to a free end of the tongue, each second contact portion having a second contact portion received in the receiving slot and spaced apart from the first contact portion along a length direction of the tongue; and a metal shell covering the insulative housing;

wherein the side surface is formed with a plurality of recessed areas penetrating through the free end of the tongue along a length direction of the tongue, and a plurality of ribs between adjacent recessed areas, the first contact portions are embedded in the recessed areas and merely exposed to the exterior along a thickness direction of the tongue.

11. The electrical connector according to claim 10, wherein the first contact portions and the second contact portions are arranged at a same side of the tongue and located at different plane along a thickness direction of the tongue.

12. The electrical connector according to claim 10, wherein the body portion defines a plurality of installed slots, and each second contact has a second securing portion retained in the installed slot.

13. The electrical connector according to claim 12, wherein the insulative housing comprises an insulator with a plurality of first blocks to engage with the installed slots and press the second securing portion.

14. The electrical connector according to claim 13, wherein the body portion defines a pair of recesses at two sides of the installed slots, and the insulator has a pair of protrusions at two sides thereof to engage with the recesses of the body portion.

15. The electrical connector according to claim 13, wherein the insulator has a clapboard parallel to the tongue.

16. The electrical connector according to claim 13, wherein the metal shell comprises an out shell covering the outside of the insulative housing and an inner shell covering two sides of the clapboard, the inner shell has two pairs of spring arms extending toward the tongue respectively.

17. The electrical connector according to claim 12, wherein each installed slot has a level section, an inclined section and a vertical section, and each second securing portion has a second level portion, a second inclined portion and a second vertical portion corresponding to each level section, inclined section and vertical section.

18. The electrical connector according to claim 10, wherein the first contact portions are flat and merely have an out surface downwardly exposed to exterior and located below the side surface, and an outer side of the ribs is coplanar to the side surface.

19. The electrical connector according to claim 10, wherein the second contacts are adapted for USB protocol and an arrangement of the second contacts is compatible to a standard USB 2.0 A type plug, and the first contacts comprise two pairs of differential signal contacts and a grounding contact between the two pairs of differential signal contacts.

20. An electrical connector comprising:

a first insulative unit defining a partition extending in a first direction and having a first deflectable contacts provided on a face thereon;

a second insulative unit attached to one side of the first insulative unit and defining a first mating tongue spaced from the partition and facing said face in a second direction perpendicular to said first direction, said second unit defining a plurality of first passageways receiving said first contacts therein, respectively;

a plurality first terminals disposed in the first mating tongue with first stiff contacting sections seated upon a face of the first mating tongue facing toward said partition;

a third insulative unit attached to the other side of the first insulative unit and defining a second mating tongue spaced from the partition and facing toward said partition in a third direction which is opposite to the second direction;

a plurality of second passageways formed in a face of the third insulative unit facing away from the partition in said second direction;

a plurality of second terminals disposed in the second mating tongue with second stiff contact sections seated upon a face of the second mating tongue facing away from the partition in said second direction; and a fourth insulative unit attached to the third insulative unit opposite to the first insulative unit, and having a plurality of second deflectable contacts on one face thereof and disposed in the corresponding second passageways, respectively.

* * * * *